US008801172B2

(12) United States Patent
Muir et al.

(10) Patent No.: US 8,801,172 B2
(45) Date of Patent: Aug. 12, 2014

(54) WEB SKEW COMPENSATION IN A PRINTING SYSTEM

(71) Applicant: Carolyn Carlisle, Centerville, OH (US)

(72) Inventors: Christopher M. Muir, Rochester, NY (US); Randy E. Armbruster, Rochester, NY (US); Thomas Niertit, Webster, NY (US); Brad Smith, Rochester, NY (US); Timothy J. Hawryschuk, Miamisburg, OH (US); James M. Enge, Spencerport, NY (US); Daniel J. DeVivo, Dayton, OH (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/663,851

(22) Filed: Oct. 30, 2012

(65) Prior Publication Data

US 2014/0118452 A1 May 1, 2014

(51) Int. Cl.
*B41J 2/01* (2006.01)

(52) U.S. Cl.
USPC ..... 347/104; 347/8; 347/14; 347/5

(58) Field of Classification Search
USPC ..... 347/104, 101, 8, 14, 12, 5
See application file for complete search history.

(56) References Cited

U.S. PATENT DOCUMENTS

2006/0132524 A1* 6/2006 Ikegame ..... 347/16
2012/0206550 A1* 8/2012 Takeuchi et al. ..... 347/104

* cited by examiner

*Primary Examiner* — Henok Legesse
(74) *Attorney, Agent, or Firm* — Nancy R. Simon; Amit Singhal

(57) ABSTRACT

A printing system includes one or more lineheads that jet ink onto a first side of a print media. At least one roller supports a second side of the print media as the print media is transported through the printing system. A roller deformation adjustment mechanism abuts at least one roller and is configured to apply a force to the roller to deform the roller. The deformation of the roller compensates for web skew by changing the relative timing of ink flight times from the linehead to the first side of the print media. The linehead can be disposed on a movable support. The printing system can also include one or more linehead skew adjustment mechanisms configured to move the movable support to adjust a skew of the linehead.

6 Claims, 17 Drawing Sheets

WEB SKEW COMPENSATION IN A PRINTING SYSTEM

CROSS-REFERENCE TO RELATED APPLICATIONS

This patent application is related to U.S. patent application Ser. No. 13/663,839, entitled "WEB SKEW COMPENSATION IN A PRINTING SYSTEM" filed concurrently herewith. This patent application is related to U.S. patent application Ser. No. 13/536,189 and U.S. patent application Ser. No. 13/536,216, both entitled "CORRECTING WEB SKEW IN A PRINTING SYSTEM" and both filed Jun. 28, 2012.

TECHNICAL FIELD

The present invention generally relates to printing systems and more particularly to systems and methods that compensate for web skew in a printing system.

BACKGROUND

Digital printing systems provide economical, high-speed, high-volume print reproduction. In this type of printing, a continuous web of print media (e.g., paper) or a support mechanism in which the print media is disposed over, is fed past one or more printing subsystems or modules that form images by applying one or more colorants onto the surface of the print media. With a continuous web, various components within the printing system are used to create tension in the web so the web does not shift in the in-track (the direction of movement) and cross-track directions as the web moves through the printing system. The tension is also used to inhibit fluttering (up or down motion) as the web travels through the printing system.

FIG. 1 illustrates a desired position for print media in a printing system. The print media 100 is positioned in a cross track direction to maintain center justification within a media operation zone 102. Typically, the center line 104 of the print media is maintained within acceptable tolerances relative to a device that is performing an operation on the print media while the print media is traveling through (located in) the media operation zone 102. A device that is performing an operation on the print media can be a linehead 106 that jets ink onto the print media or a dryer that dries the ink.

FIG. 2 is a cross-sectional view along line 2-2 in FIG. 1. Each linehead 106 jets streams of ink drops 200 on the print media 100 to produce a print line 300 (FIG. 3). When the center line 104 of the print media is maintained within acceptable tolerances, the print line 300 produced on the print media 100 is straight in the cross-track direction. Additionally, all of the print lines printed on the print media 100 by each linehead 106 are parallel with respect to each other.

FIG. 4 illustrates a top view of web skew in a printing system. Center justification of the print media 100 within the media operation zone 102 is not maintained with web skew. Instead, the print media 100 is skewed in the cross-track direction such that the centerline 104 of the print media is non-linear and curves with respect to the media transport direction of the print media. When the center line 104 of the print media is not maintained within acceptable tolerances, a print line 500 (FIG. 5) printed on the print media 100 by one or more lineheads is not straight in the cross-track direction. Web skew can cause the color planes that are printed on the print media to be misaligned with respect to each other.

Web skew can be caused by one or more factors, including non-linear accuracy of web edge sensors that position the web in the cross track direction, web camber, or misalignment of rollers through the media operation zone 102. Web skew can cause significant delay in the setup of the printing system. In order to make corrections, operators of the printing system must manually evaluate web skew via eye-loop measurements of printed output. The operator must then manually change web servo setpoints to make the necessary corrections to web skew, which is often an iterative process.

SUMMARY

According to one aspect, a printing system includes one or more lineheads that jet ink onto a surface of a print media and an imaging system that captures images of the surface of the print media. At least one roller to support the print media is positioned opposite each linehead. A roller deformation adjustment mechanism abuts each roller and is configured to apply a force to the roller to deform the roller. The deformation of a roller compensates for web skew by changing the relative timing of the flight times of ink from the linehead to the surface of the print media.

In another aspect, the printing system can include one or more linehead skew adjustment mechanisms that are adapted to adjust the skew of the linehead.

In another aspect, a method for compensating for web skew in the printing system includes capturing images of one or more test marks printed or formed on the print media and analyzing the images to determine whether the print media is skewed with respect to a transport direction of the print media. If the print media is skewed, one or more compensation values that are used to deform the roller are determined. The roller is then deformed based on the one or more compensation values. The deformation of the roller changes a relative timing of drop flight times of ink between the linehead and the surface of the print media.

In another aspect, if the print media is skewed, the method can include determining one or more linehead skew adjustment values, and adjusting the skew of the linehead based on the one or more linehead skew adjustment values.

BRIEF DESCRIPTION OF THE DRAWINGS

Embodiments of the invention are better understood with reference to the following drawings. The elements of the drawings are not necessarily to scale relative to each other. Like numbers indicate like parts throughout the views.

DETAILED DESCRIPTION

Figure 1:
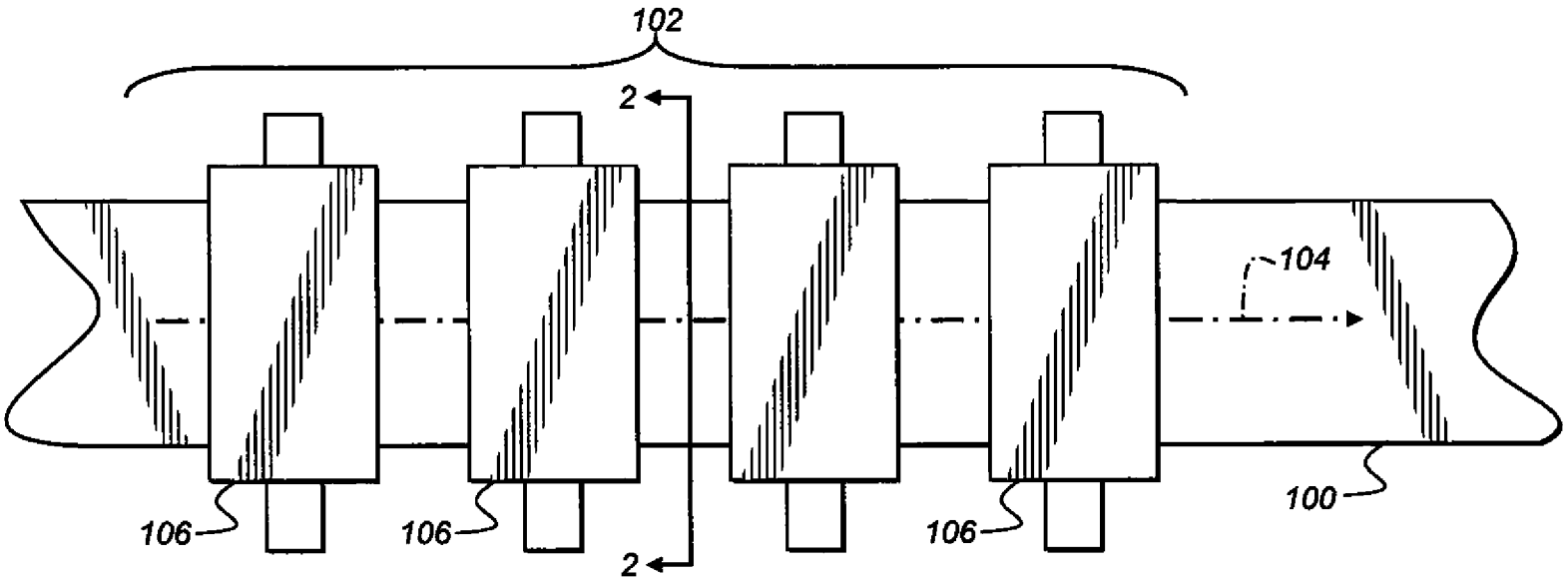
FIG. 1 (Prior Art)
FIG. 1 illustrates a desired position for print media in a printing system.
Figure 2:
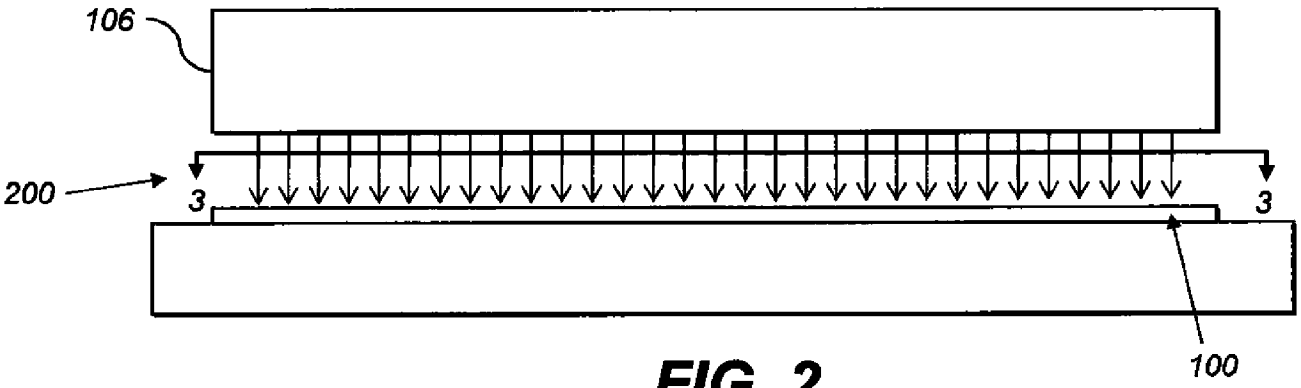
FIG. 2 (Prior Art)
FIG. 2 is a cross-sectional view along line 2-2 in FIG. 1.
Figure 3:
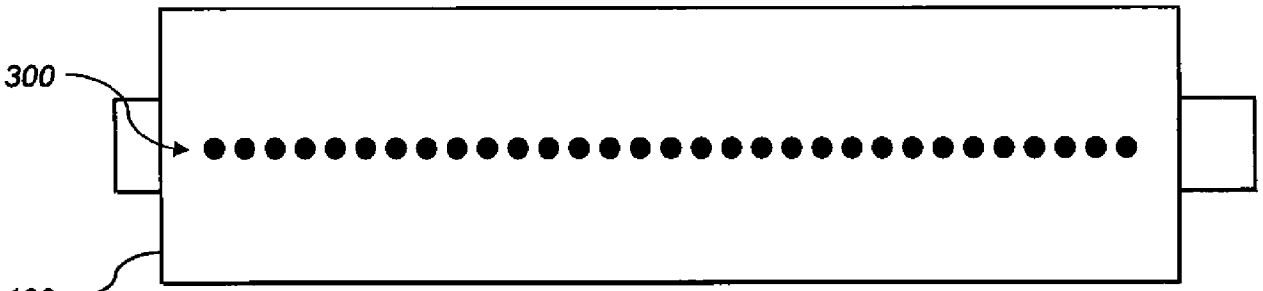
FIG. 3 (Prior Art)
FIG. 3 is a cross-sectional view along line 3-3 in FIG. 2.
Figure 4:
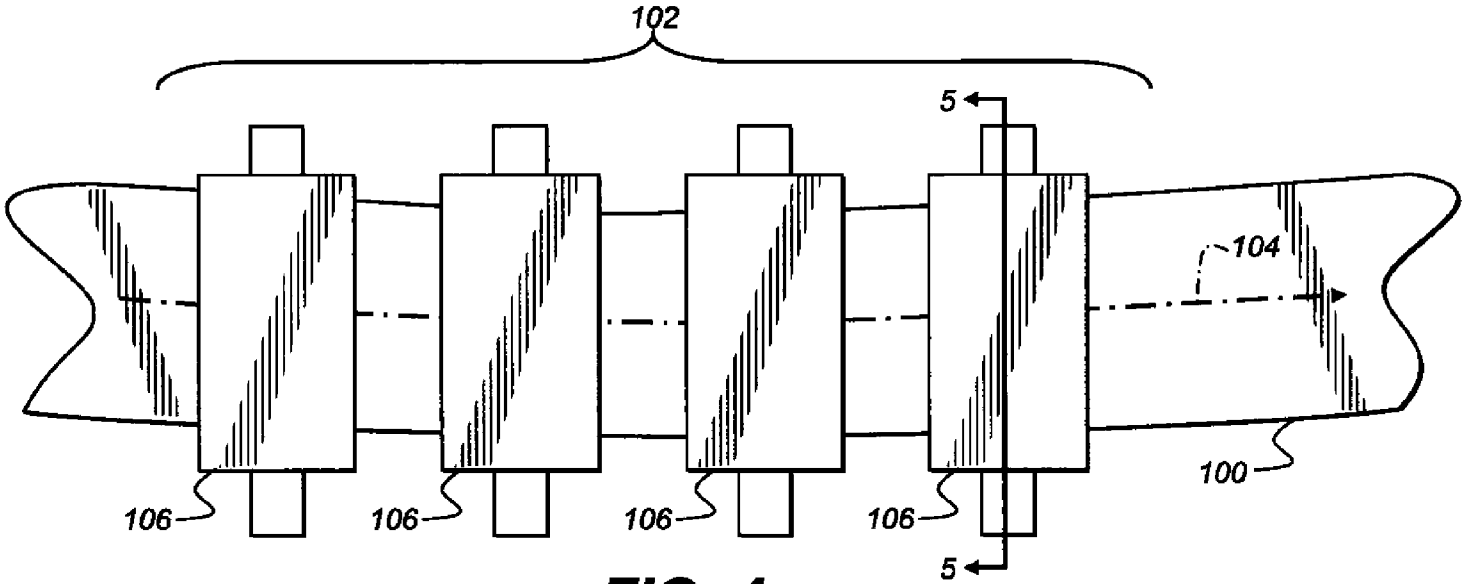
FIG. 4 (Prior Art)
FIG. 4 illustrates a top view of web skew in a printing system.
Figure 5:
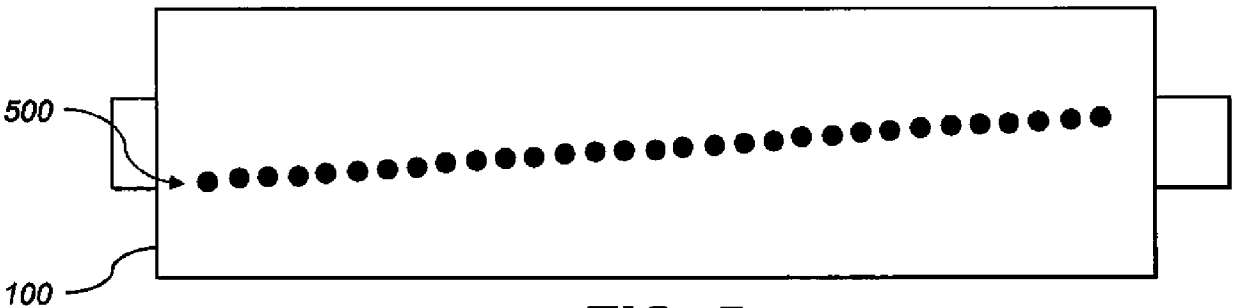
FIG. 5 (Prior Art)
FIG. 5 is a cross-sectional view along line 5-5 in FIG. 4.

Throughout the specification and claims, the following terms take the meanings explicitly associated herein, unless the context clearly dictates otherwise. The meaning of "a," "an," and "the" includes plural reference, the meaning of "in" includes "in" and "on." Additionally, directional terms such as "on", "over", "top", "bottom", "left", "right" are used with reference to the orientation of the Figure(s) being described. Because components of embodiments of the present invention can be positioned in a number of different orientations, the directional terminology is used for purposes of illustration only and is in no way limiting.

The present description will be directed in particular to elements forming part of, or cooperating more directly with, an apparatus in accordance with the present invention. It is to be understood that elements not specifically shown, labeled, or described can take various forms well known to those skilled in the art. In the following description and drawings, identical reference numerals have been used, where possible, to designate identical elements. It is to be understood that elements and components can be referred to in singular or plural form, as appropriate, without limiting the scope of the invention.

The example embodiments of the present invention are illustrated schematically and not to scale for the sake of clarity. One of ordinary skill in the art will be able to readily determine the specific size and interconnections of the elements of the example embodiments of the present invention.

As described herein, the example embodiments of the present invention compensate for web skew as a web is transported through a printing system. The web can be the print media or a support mechanism that is routed through the printing system. Inkjet printing is commonly used for printing on paper, where paper is the print media. However, there are numerous other materials in which inkjet is appropriate. For example, vinyl sheets, plastic sheets, textiles, paperboard, and corrugated cardboard can comprise the print media. Additionally, although the term inkjet is often used to describe the printing process, the term jetting is also appropriate wherever ink or other liquids is applied in a consistent, metered fashion, particularly if the desired result is a thin layer or coating.

However, many other applications are emerging which use inkjet printheads to emit liquids (other than inks) that need to be finely metered and deposited with high spatial precision. Such liquids include inks, both water based and solvent based, that include one or more dyes or pigments. These liquids also include various substrate coatings and treatments, various medicinal materials, and functional materials useful for forming, for example, various circuitry components or structural components. As such, as described herein, the terms "liquid" and "ink" refer to any material that is ejected by the printhead or printhead components described below.

Inkjet printing is a non-contact application of an ink to a print media. Typically, one of two types of ink jetting mechanisms are used and are categorized by technology as either drop on demand ink jet (DOD) or continuous ink jet (CIJ). The first technology, "drop-on-demand" (DOD) ink jet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

The second technology commonly referred to as "continuous" ink jet (CIJ) printing, uses a pressurized ink source to produce a continuous liquid jet stream of ink by forcing ink, under pressure, through a nozzle. The stream of ink is perturbed using a drop forming mechanism such that the liquid jet breaks up into drops of ink in a predictable manner. One continuous printing technology uses thermal stimulation of the liquid jet with a heater to form drops that eventually become print drops and non-print drops. Printing occurs by selectively deflecting one of the print drops and the non-print drops and catching the non-print drops. Various approaches for selectively deflecting drops have been developed including electrostatic deflection, air deflection, and thermal deflection.

Additionally, there are typically two types of web used with inkjet printing systems. The first type is commonly referred to as a continuous web while the second type is commonly referred to as a cut sheet(s). The continuous web refers to a continuous strip of print media, generally originating from a source roll. The continuous web is moved relative to the inkjet printing system components via a web transport system, which typically include drive rollers, web guide rollers, and web tension sensors. Cut sheets refer to individual sheets of print media that are moved relative to the inkjet printing system components via a support mechanism (e.g., rollers and drive wheels or via a conveyor belt system) that is routed through the inkjet printing system.

The invention described herein is applicable to both types of printing technologies. As such, the terms linehead and printhead, as used herein, are intended to be generic and not specific to either technology. Additionally, the invention described herein is applicable to both types of print media. As such, the terms print media and web, as used herein, is intended to be generic and not as specific to either type of print media or the way in which the print media is moved through the printing system. The terms linehead, printhead, print media, and web can also be applied to other nontraditional inkjet applications, such as printing conductors on plastic sheets or medicines or materials on skin.

The terms "upstream" and "downstream" are terms of art referring to relative positions along the transport path of the web; points on the transport path move from upstream to downstream. In FIGS. 6-8, 10, 16, and 17 the print media moves in the direction indicated by media transport direction arrow 614. Where they are used, terms such as "first", "second", and so on, do not necessarily denote any ordinal or priority relation, but are simply used to more clearly distinguish one element from another.

Figure 6:
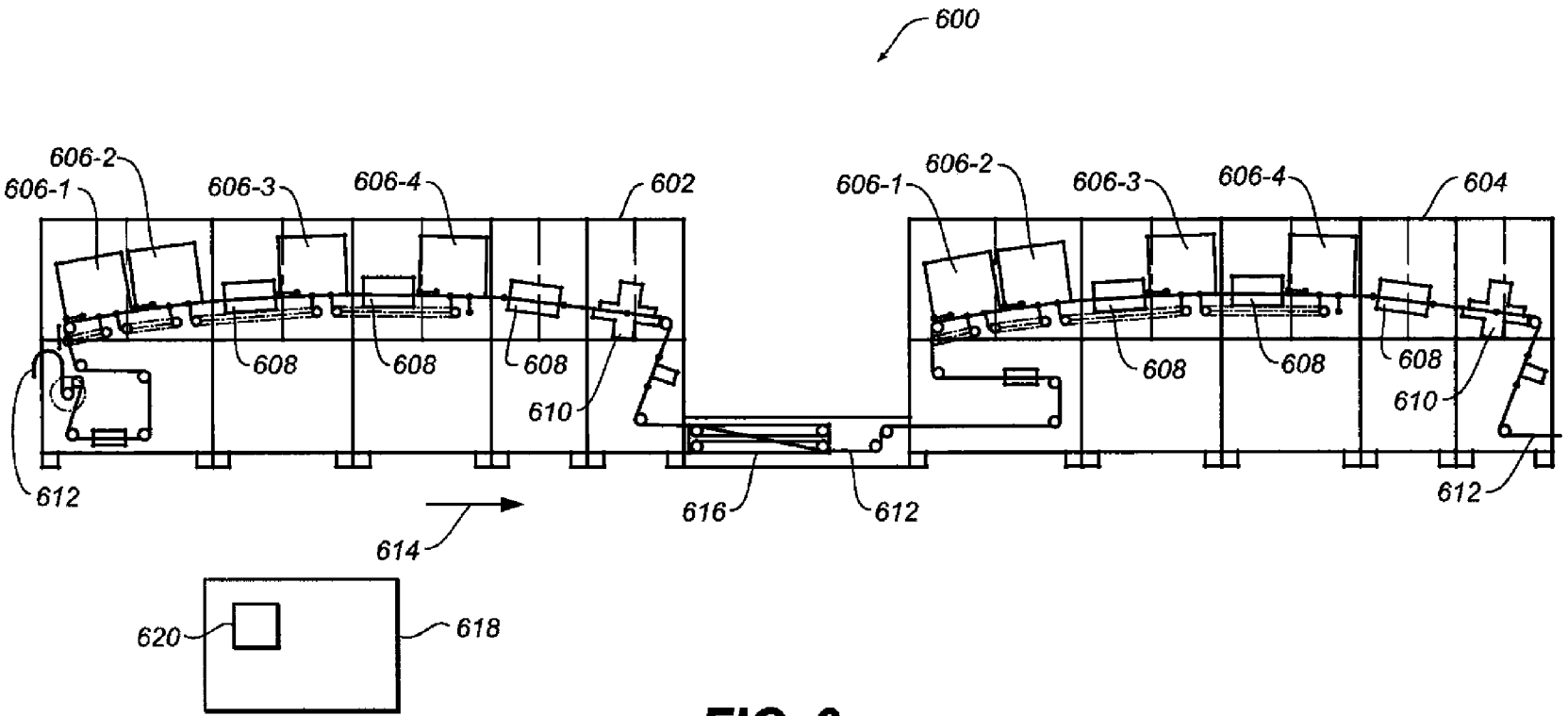
FIG. 6 depicts one example of an inkjet printing system for continuous web printing on a print media.

Referring now to FIG. 6, there is shown one example of an inkjet printing system for continuous web printing on a print media. Printing system 600 includes a first printing module 602 and a second printing module 604, each of which includes lineheads 606, dryers 608, and a quality control sensor 610 positioned opposite a surface of the print media 612. Each linehead 606 typically includes multiple printheads (not shown) that apply ink or another liquid to a surface of the continuous web of print media 612. For descriptive purposes only, the lineheads 606 are labeled a first linehead 606-1, a second linehead 606-2, a third linehead 606-3, and a fourth linehead 606-4. In the illustrated embodiment, each linehead 606-1, 606-2, 606-3, 606-4 applies a different colored ink to the surface of the print media 612 that is adjacent to the lineheads. By way of example only, linehead 606-1 applies cyan colored ink, linehead 606-2 magenta colored ink, linehead 606-3 yellow colored ink, and linehead 606-4 black colored ink.

The first printing module 602 and the second printing module 604 also include a web tension system that serves to physically move the print media 612 through the printing system 600 in the media transport direction 614 (left to right as shown in the figure). The print media 612 enters the first printing module 602 from a source roll (not shown) and the linehead(s) 606 of the first printing module 602 applies ink to one side of the print media 612. As the print media 612 feeds into the second printing module 604, a turnover module 616 is adapted to invert or turn over the print media 612 so that the linehead(s) 606 of the second printing module 604 can apply ink to the other side of the print media 612. The print media 612 then exits the second printing module 604 and is collected by a receiving unit (not shown).

Processing device 618 can be connected to various components in the web tension system and used to control the positions of the components, such as the servo motors, gimbaled or caster rollers. Processing device 618 can be connected to the quality control sensor 610 and used to process images or data received from the sensor 610. Processing device can be connected to components in printing system 600 using any known wired or wireless communication connection. Processing device 618 can be separate from printing system 600; integrated within printing system 600; or integrated within a component in printing system 600. The processing device 618 can be implemented as one or more processing devices, such as a computer or a programmable logic circuit.

Connected to the processing device 618 is storage device 620. The storage device 620 can store compensation values that are used by one or more roller deformation adjustment mechanisms to adjust the deformation of one or more rollers to change the relative timing of the drop flight time from a printhead to the print media. Changing the relative timing of one or more drop flight times can compensate for web skew. Storage device 620 can also store one or more linehead skew adjustment values that are used to adjust the skew of one or more lineheads. Adjusting the skew of one or more lineheads can compensate for web skew. The storage device 620 can be implemented as one or more external storage devices; one or more storage devices included within the processing device 618; or a combination thereof.

Although FIG. 6 depicts each printing module with four lineheads 606, three dryers 608, and one quality control sensor 610, embodiments in accordance with the invention are not limited to this construction. A printing system can include any number of lineheads, any number of dryers, and any number of quality control sensors. The printing system can also include a number of other components, including, but not limited to, web cleaners and web tension sensors.

And although the printing system shown in FIG. 6 has the turnover module 616 disposed between the first and second printing modules 602, 604, other printing systems can include the turnover module within one of the printing modules.

Figure 7:
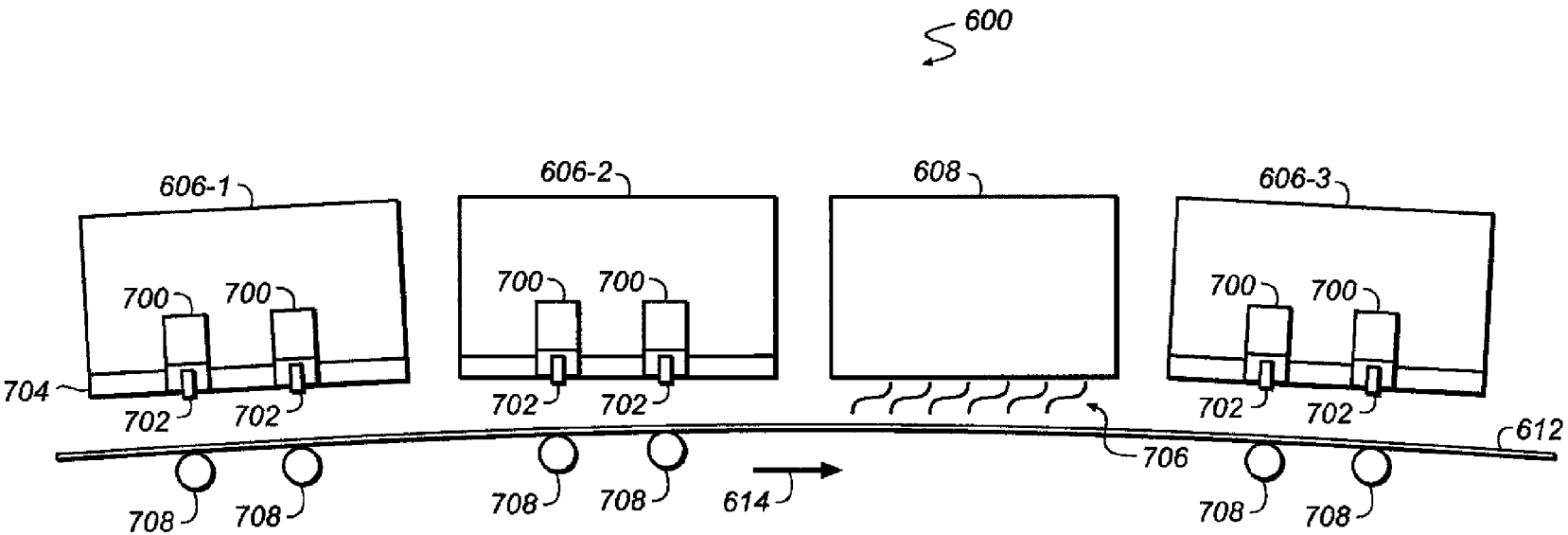
FIG. 7 illustrates an example of a portion of printing system 600 in an embodiment in accordance with the invention.

FIG. 7 depicts a portion of the printing system 600 shown in FIG. 6 in more detail. As the print media 612 is directed through the printing system 600, the lineheads 606, which typically include a plurality of printheads 700, apply ink or another liquid to the print media 612 via the nozzle arrays 702 of the printheads 700. The printheads 700 within each linehead 606 are located and aligned by a support structure 704. After the ink is jetted onto the print media 612, the print media 612 passes beneath the dryer 608, which applies heat or air 706 to the print media to dry the ink.

The print media 612 is supported by rollers 708 that are positioned on a side of the print media that is opposite the side adjacent to the printheads 700. The rollers 708 can be stationary or can rotate in embodiments in accordance with the invention. Each roller 708 is typically aligned with a print line of each row of printheads. The rollers 708 prevent the print media that is opposite the lineheads 606 from fluttering and contacting the support structure 704. One or more of the rollers 708 are deformed to change the relative timing of the drop flight time of the ink drops from a printhead to the print media in an embodiment in accordance with the invention. As described earlier, changing the relative timing of one or more drop flight times can compensate for web skew. Other embodiments in accordance with the invention can deform different rollers in a printing system to compensate for web skew.

Figure 8:
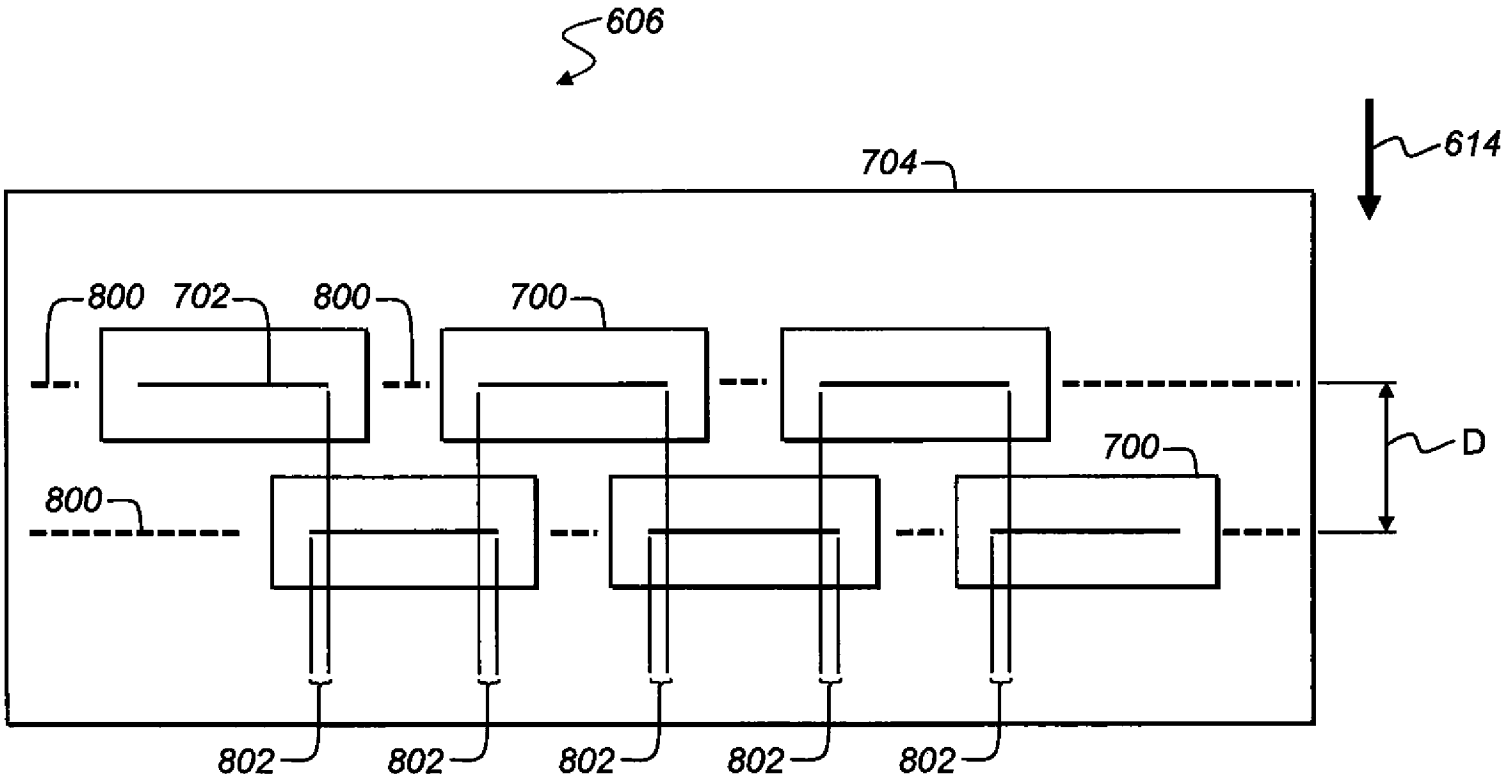
FIG. 8 depicts an example of an arrangement of printheads 700 in a linehead 606 in an embodiment in accordance with the invention.

Referring now to FIG. 8, there is shown an example of an arrangement of printheads 700 in a linehead 606 in an embodiment in accordance with the invention. A face of the support structure 704 that is adjacent to the print media 612 is shown. The printheads 700 are aligned in two or more rows in a staggered formation. The nozzles arrays 702 of the printheads in each row rows of printheads 700 lie along a line, called a print line 800, which is parallel to the cross-track direction and perpendicular to the direction of motion of the print media (denoted by the arrow 614). The nozzle array 702 of each printhead is also aligned along the cross-track direction.

The print lines 800 for the rows of nozzle arrays 702 are spaced apart by a distance D. The ends of the nozzle arrays 702 in one row overlap with the ends of the nozzles arrays in the other row to produce overlap regions 802. The overlap regions 802 enable the print from overlapped printheads 700 to be stitched together without a visible seam through the use of appropriate stitching algorithms that are known in the art. As described earlier, a roller 708 (FIG. 7) is aligned with a respective print line of each row of printheads to prevent the print media from fluttering at each of the print lines 800.

Water-based inks or liquids jetted from the lineheads 606 add moisture to the print media 612, which can cause the print media to expand, especially in the cross-track direction. The added moisture also lowers the stiffness of the print media 612. And each dryer 608 drives moisture out of the print media 612, causing the print media to shrink and its stiffness to change. These changes to the print media 612 can cause the print media 612 to drift in the cross-track direction as the print media passes through each printing module in a printing system. As discussed earlier, the print lines are not parallel to each other and to the cross-track direction when the print media is skewed.

Figure 9:
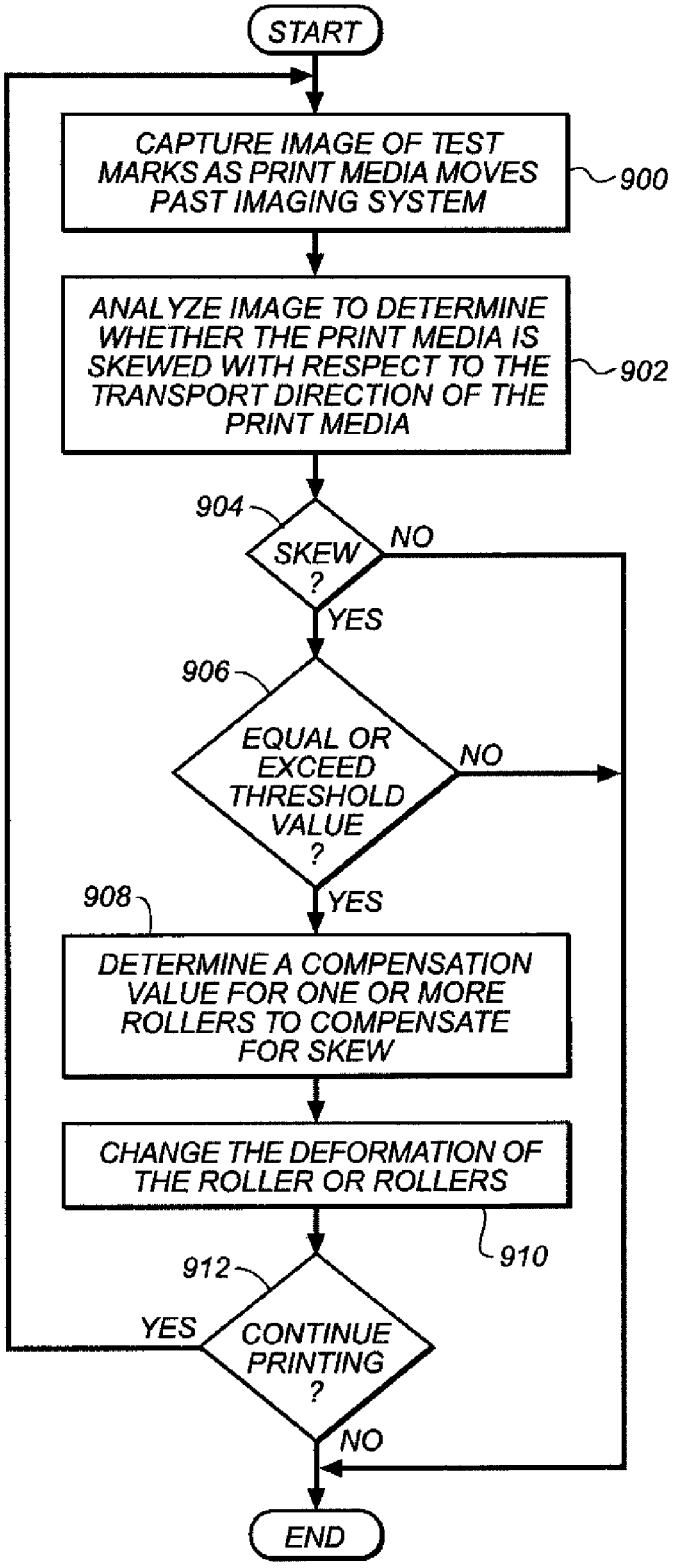
FIG. 9 is a flowchart of a first method for compensating for web skew in a printing system in an embodiment in accordance with the invention.

FIG. 9 is a flowchart of a first method for compensating for web skew in a printing system in an embodiment in accordance with the invention. Initially, one or more images of a test mark or marks is captured as the print media moves past an imaging system (block 900). By way of example only, the imaging system can be implemented as the quality control sensor 610 in FIG. 6.

Figure 10:
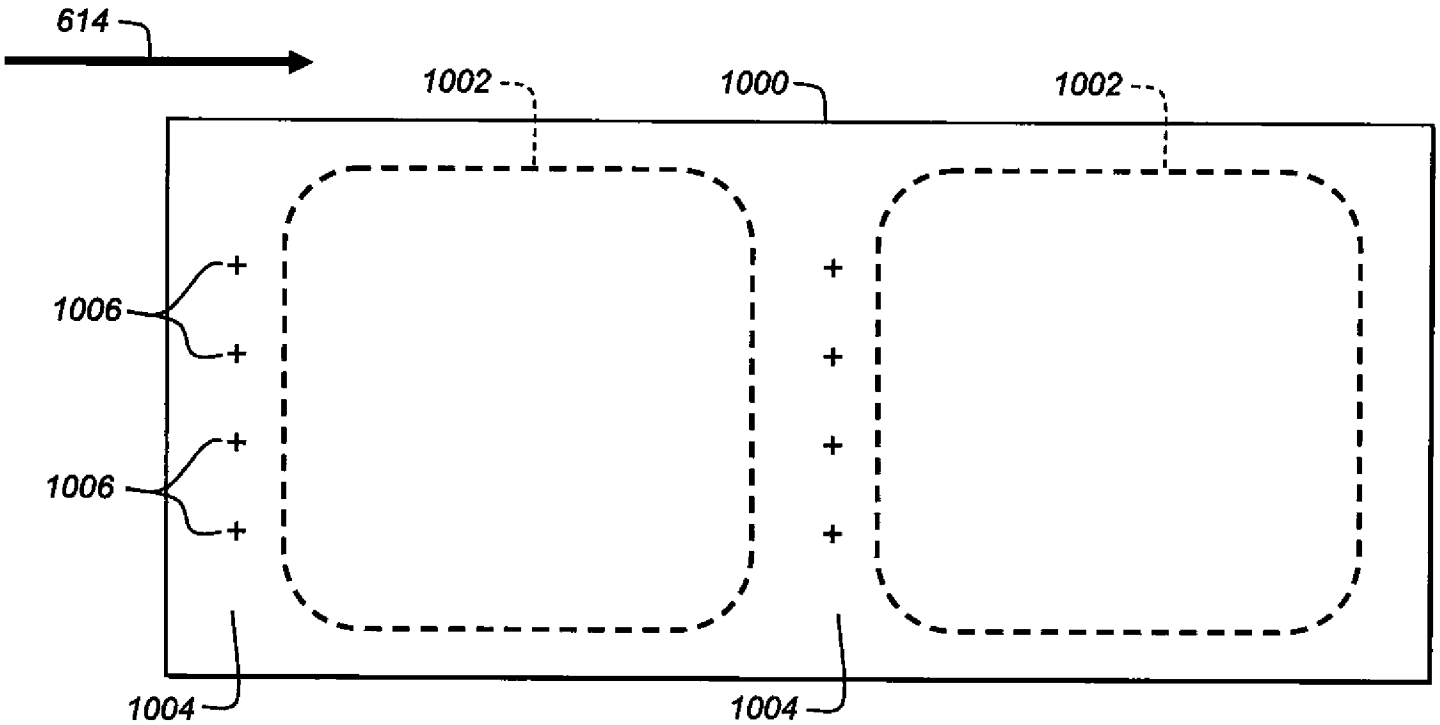
FIG. 10 is a graphical illustration of a print media in an embodiment in accordance with the invention.

One example of test marks is depicted in FIG. 10. A print media 1000 includes a content area 1002 and a margin 1004 that surrounds one or more sides of the content area 1002. The content area 1002 is an area on the print media where published information such as text, images, animation, and graphics will be printed on the print media. The margin 1004 of the print media 1000 is where non-published information is printed. In some embodiments, some or all of the non-published information is removed or cut away prior to completing a print job.

Included in the margin are test marks 1006 that are printed or formed on the print media. In some embodiments, each linehead prints a test mark so that all of the ink colors are used to print test marks 1006 on the print media. The test marks are implemented as fiducial marks in the illustrated embodiment. Other embodiments in accordance with the invention can configure the test marks differently. By way of example only, a test mark can be one or more lines, one or more dots, one or more boxes, or one or more sets of dots with each set including one or more dots.

The test mark or marks can be implemented as visible test marks or as non-objectionable test marks printed, pre-printed, or formed on the print media. Non-objectionable test marks form a pattern, shape, or design that is not significantly discernable by the human vision system or intelligence but can be detected by an imaging system. The marks can be regularly or irregularly spaced so long as they appear non-objectionable.

Returning to FIG. 9, the image of the one or more test marks is analyzed at block 902 to determine whether the print media is skewed with respect to the media transport direction (i.e., the in-track direction). In one embodiment, one test mark is used as a reference test mark and the remaining test marks are compared to the reference test mark. By way of example only, the reference test mark can be the test mark produced by the first linehead in a printing module. Typically, the print media is less likely to be skewed when the print media first enters a printing module because the print media has been aligned (e.g., center aligned) prior to entering the printing module. Also, the print media is usually dry and has not experienced any expansion or stretch due as a result of jetted liquid, or contraction or shrink as a result of the dryers. In the embodiment illustrated in FIG. 6, the test mark produced by linehead 606-1 can be used as the reference test mark. Other embodiments in accordance with the invention can use a different test mark as the reference mark.

Other embodiments in accordance with the invention can determine if the print media is skewed differently. For example, the image of the one or more test marks can be compared to a reference image. The reference image can be stored in a storage device, such as storage device 620 in FIG. 6. Alternatively, the image of the one or more test marks can be compared to a reference line or box printed or formed on the print media. The position of one or both edges of the web can be determined at different locations in the printing system. By way of example only, an edge sensor can be used to determine the position of the edges of the web. And finally, the direction of the web at one or more single locations in the printing system can be determined and compared to the overall media transport direction.

A determination is then made at block 904 as to whether or not the print media is skewed. If the print media is skewed, a determination is made at block 906 as to whether or not the amount of skew equals or exceeds a threshold value. If the amount of skew equals or exceeds the threshold value, the process passes to block 908 where a compensation value (or values) is determined for one or more rollers. The compensation value or values is used to adjust the deformation of one or more rollers to compensate for the skew. By way of example only, processing device 618 (FIG. 6) can analyze the images to determine if the print media is skewed and determine the compensation values. The compensation values can be stored in a storage device, such as storage device 620 in FIG. 6.

Next, at block 910, one or more rollers is deformed to change the relative timing of the drop flight times of the ink from a printhead (or multiple printheads) to the print media. In one embodiment in accordance with the invention, the set points for one or more roller deformation adjustment mechanisms can be adjusted, if needed, based on the compensation values. The roller deformation adjustment mechanisms are described in more detail in conjunction with FIGS. 13 and 14.

A determination is then made at block 912 as to whether or not printing on the print media is to continue. If the printing continues, the method returns to block 900 and repeats until printing is complete.

Figure 11:
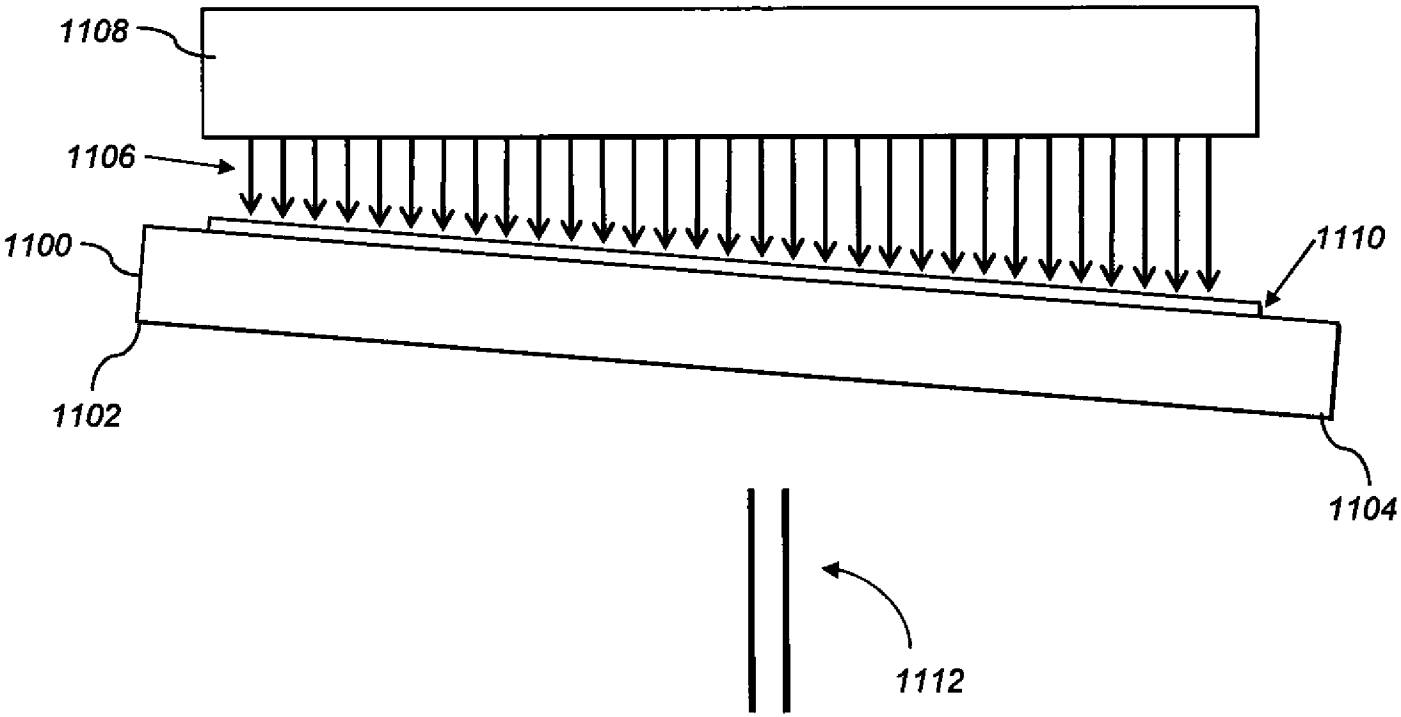
FIGS. 11-12 illustrate examples of roller deformation in a printing system in an embodiment in accordance with the invention.
Figure 12:
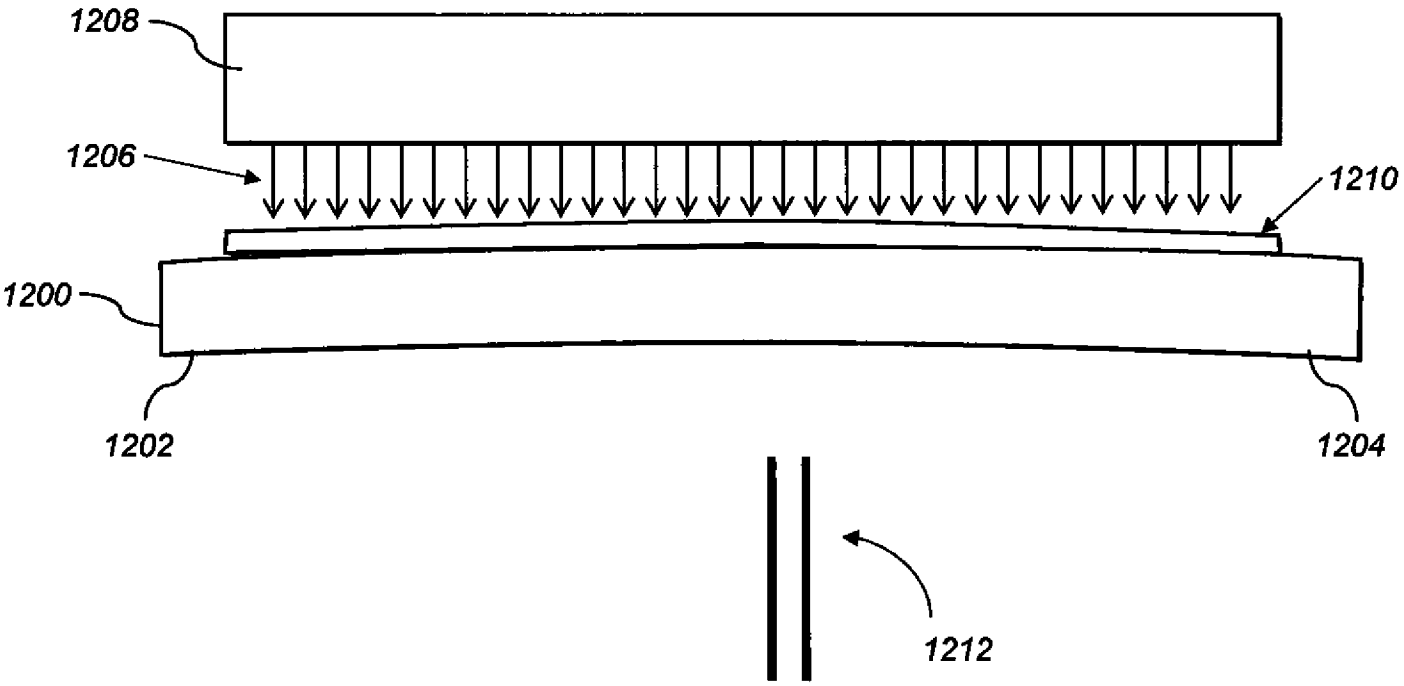

FIGS. 11-12 illustrate examples of roller deformation in a printing system in an embodiment in accordance with the invention. In the embodiment illustrated in FIG. 11, roller 1100 has been deformed to tilt downward from end 1102 to end 1104. The streams of ink drops 1106 have different drop flight times from the linehead 1108 to the print media 1110. The streams of ink drops near end 1102 have the shortest drop flight times while the streams of ink drops near end 1104 have the longest drop flight times. The print lines 1112 produced by the linehead 1108 are parallel and straight when the roller 1100 is deformed.

FIG. 12 depicts a roller 1200 deformed to curve or bow between ends 1202, 1204. The streams of ink drops 1206 near the ends 1202, 1204 have different drop flight times from the linehead 1208 to the print media 1210 compared to the streams of ink drops near the middle of the roller. The streams of ink drops near the ends 1202, 1204 have longer drop flight times than the streams of ink drops near the middle of the roller 1200. The print lines 1212 produced by the linehead 1108 are parallel and straight when the roller 1200 is deformed.

Figure 13:
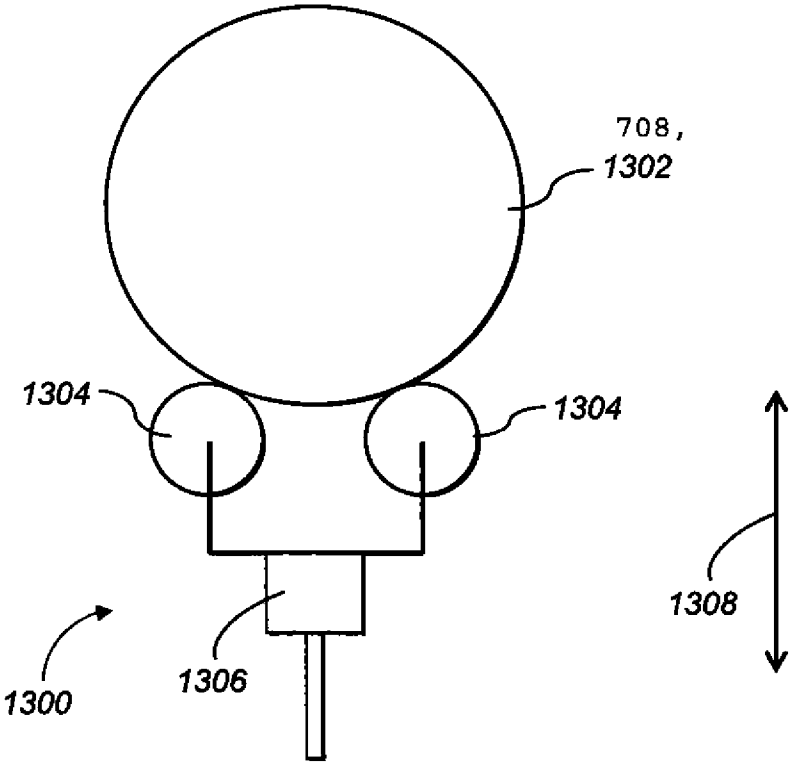
FIGS. 13-14 illustrate an example of a roller and a roller deformation adjustment mechanism in an embodiment in accordance with the invention.
Figure 14:
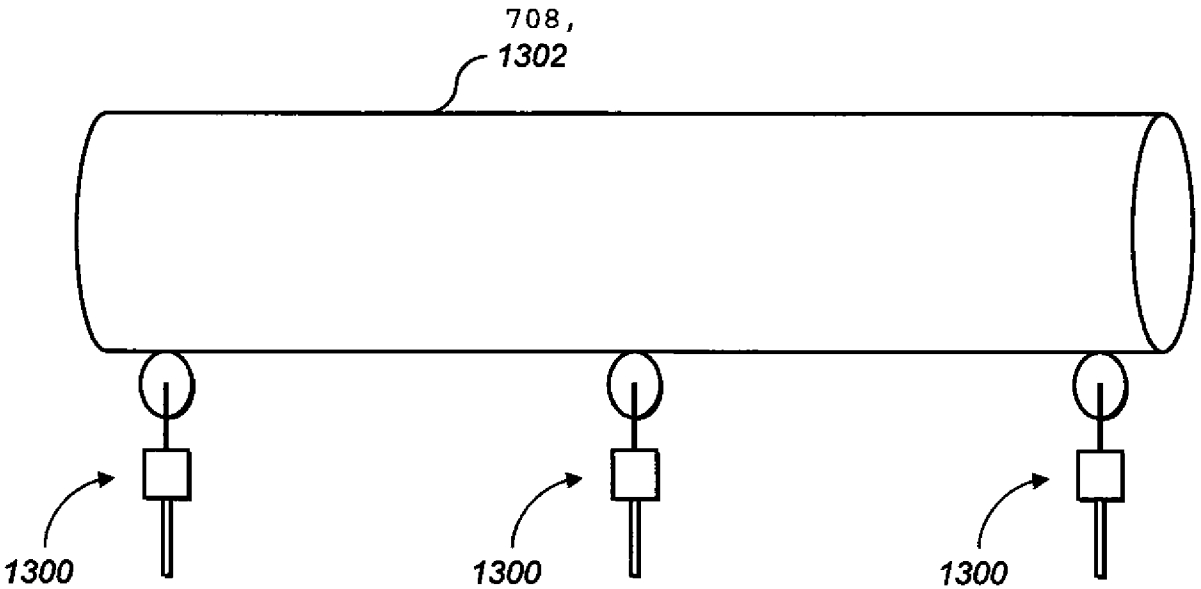

Referring now to FIGS. 13-14, there are shown examples a roller and roller deformation adjustment mechanisms in an embodiment in accordance with the invention. FIG. 13 depicts an end view of a roller 1302 with a roller deformation adjustment mechanism 1300 abutting the roller 1302. The roller deformation adjustment mechanism 1300 includes two adjustment rollers 1304 and a drive system 1306 connected to the two adjustment rollers. The adjustment rollers 1304 can be stationary or can rotate in embodiments in accordance with the invention.

FIG. 14 illustrates a side view of the roller 1302. One or more roller deformation adjustment mechanisms 1300 can be used to deform the roller 1302.

The drive system 1306 applies a force to the roller 1302 through the adjustment rollers 1304. To deform the roller 1302, the drive system 1306 can increase and decrease the amount of force applied to the roller 1302 (represented by double-headed arrow 1308). The drive system 1306 can increase the force applied to the roller 1302 by lifting or driving the adjustment rollers 1304 against roller 1302. The drive system 1306 can decrease the force applied to the roller 1302 by lowering the adjustment rollers 1304 from roller 1302. The drive system 1306 can apply less force to the roller 1302 or apply no force to the roller 1302. The drive system 1306 can be implemented as a servo system, a piezo system, or other mechanical or electrical systems. Adjusting the deformation of the roller 1302 based on the one or more compensation values can include determining a set point for the drive system.

Embodiments in accordance with the invention can monitor the skew of the print media during a print job and adjust the deformation of one or more rollers periodically or at select times. Before beginning a print job, a test print can be performed and the deformation of one or more rollers calibrated for the print job.

Figure 15:
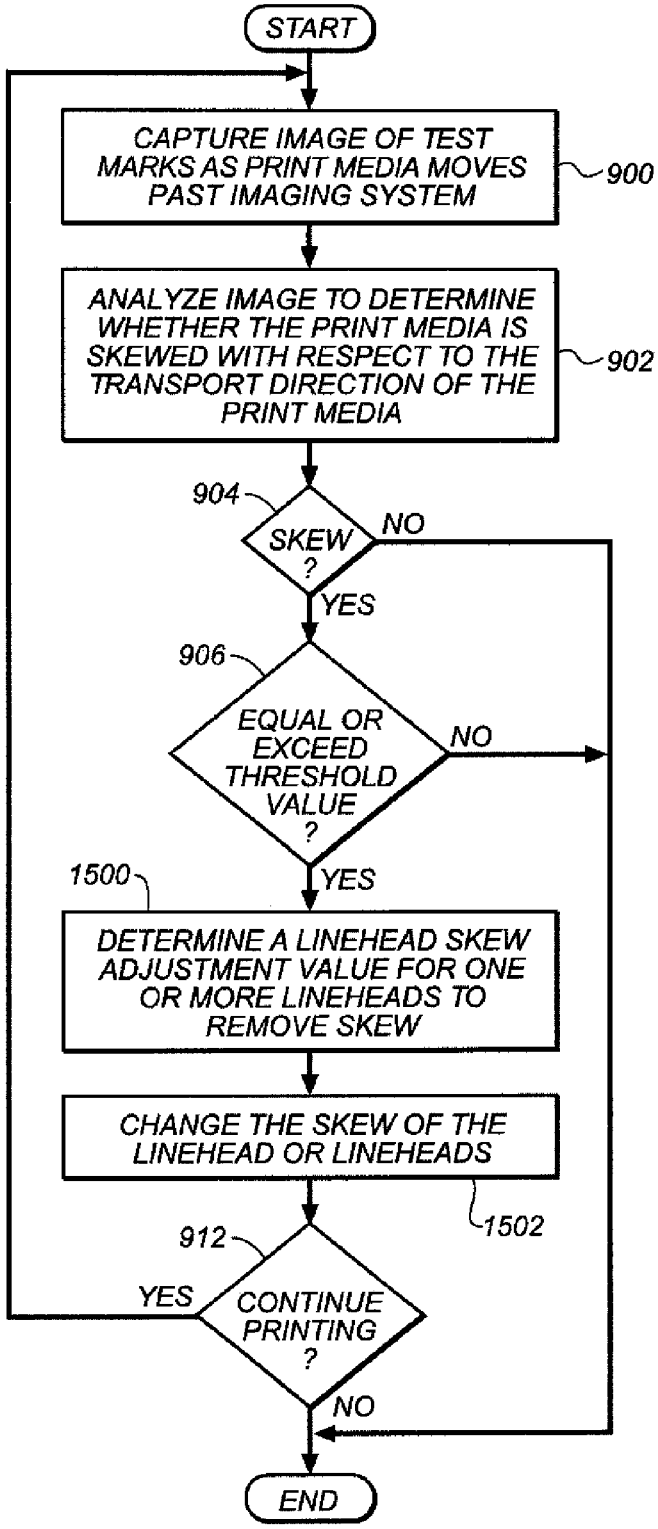
FIG. 15 is a flowchart of a second method for compensating for web skew in a printing system in an embodiment in accordance with the invention.

Web skew can be compensated for using another method in conjunction with the method disclosed in FIG. 9. FIG. 15 is a flowchart of a second method for compensating for web skew in a printing system in an embodiment in accordance with the invention. Blocks 900, 902, 904 and 906 can be implemented as described in conjunction with FIG. 9. In one embodiment, blocks 900, 902, 904 and 906 are performed once and blocks 908, 910, 1500 and 1502 are performed in parallel or sequentially. In another embodiment, the method in FIG. 9 can be performed a select times and the method in FIG. 15 at different select times. For example, the methods can be alternately performed during a print job.

If at block 906 it is determined the amount of skew equals or exceeds the threshold value, the process passes to block 1500 where a linehead skew adjustment value (or values) is determined for one or more lineheads. The linehead skew adjustment value or values is used to adjust the skew of the one or more lineheads to compensate for the skew. By way of example only, processing device 618 (FIG. 6) can analyze the images to determine if the print media is skewed and determine the linehead skew adjustment values. The linehead skew adjustment values can be stored in a storage device, such as storage device 620 in FIG. 6.

Next, at block 1502, the skew of the one or more lineheads is adjusted to correct for the skew of the print media. In one embodiment in accordance with the invention, the set points for one or more servo motors can be adjusted, if needed, based on the linehead skew adjustment values. The servo motors are described in more detail in conjunction with FIG. 19.

A determination is then made at block 912 as to whether or not printing on the print media is to continue. If the printing continues, the method returns to block 900 and repeats until printing is complete.

Figure 16:
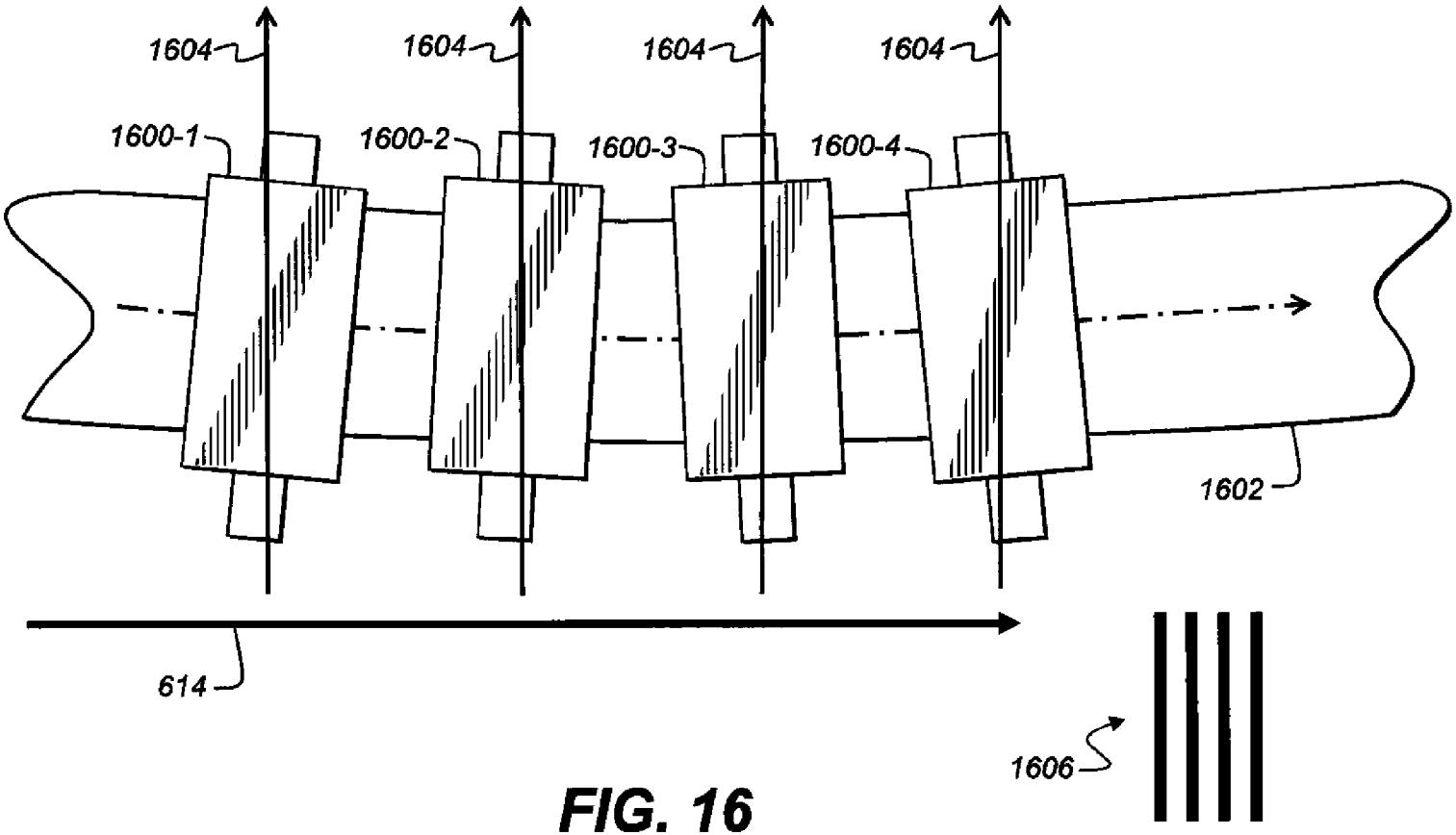
FIGS. 16-17 depict examples of the skew of the linehead in a printing system after compensating for web skew in an embodiment in accordance with the invention.
Figure 17:
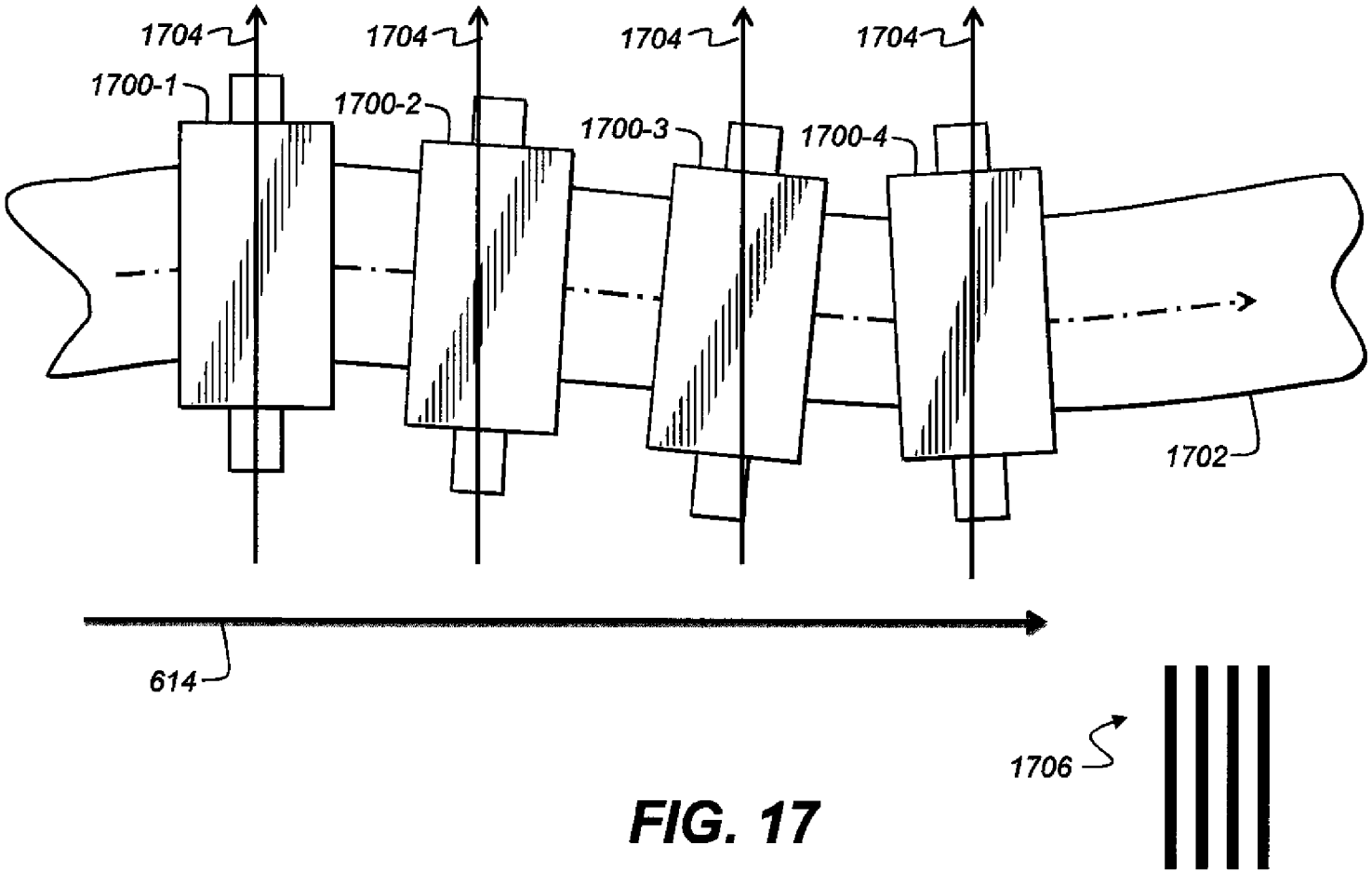

FIGS. 16-17 illustrate examples of the skew of the lineheads in a printing system after compensating for web skew in an embodiment in accordance with the invention. In the embodiment shown in FIG. 16, the skew of all four lineheads 1600-1, 1600-2, 1600-3, 1600-4 has be adjusted to correct for the skew in the print media 1602. The lineheads 1600-1, 1600-2, 1600-3, 1600-4 are no longer positioned perpendicular to the in-track direction (transport direction 614) and parallel to the cross-track direction. Instead, each linehead is skewed with respect to line 1604 (line 1604 represents the cross-track direction). With the skew adjusted, the lineheads produce parallel and straight print lines 1606 on the print media 1602.

FIG. 17 depicts the skew of all four lineheads 1700-1, 1700-2, 1700-3, 1700-4 after an adjustment to correct for the skew in the print media 1702. The linehead 1700-1 is positioned perpendicular to the in-track direction and parallel to the cross-track direction, but the other lineheads 1700-2, 1700-3, 1700-4 are not positioned perpendicular to the in-track direction or parallel to the cross-track direction (line 1704 represents the cross-track direction). With the skew of three lineheads adjusted, the lineheads produce parallel and straight print lines 1706 on the print media 1702.

Figure 18:
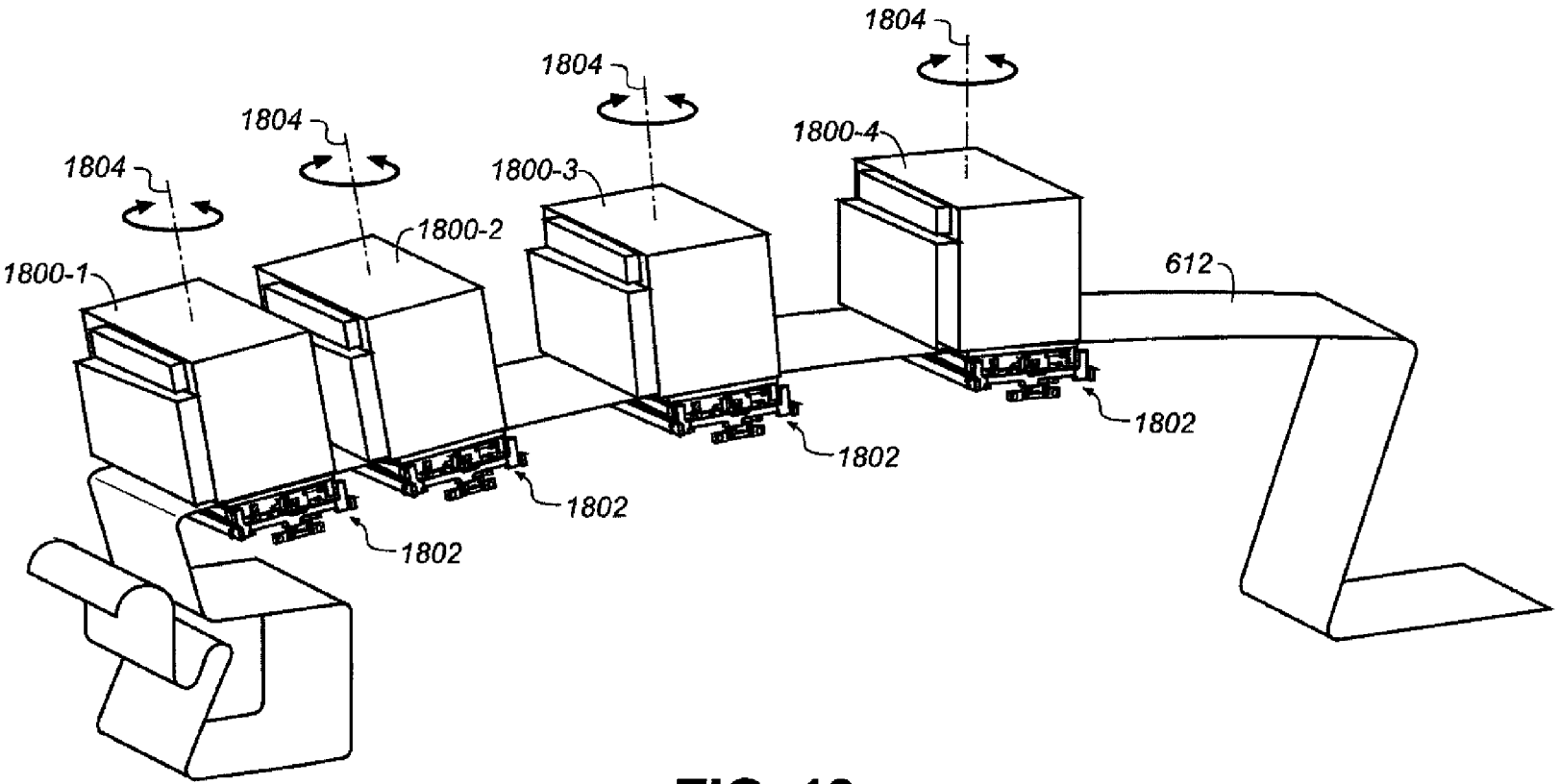
FIG. 18 illustrates one example of the skew degree of freedom for the lineheads in a printing system in an embodiment in accordance with the invention.

Referring now to FIG. 18, there is shown one example of the skew degree of freedom for the lineheads in a printing system in an embodiment in accordance with the invention. The print media 612 is depicted along its path of travel through the printing system 600 in FIG. 6. The lineheads 1800-1, 1800-2, 1800-3, 1800-4 each sit on a movable support 1802 in the illustrated embodiment. Each linehead can be independently moved or rotated around line 1804. By way of example only, a linehead or a moveable support can be moved or rotated +/−0.2 degrees around line 1804.

In one embodiment in accordance with the invention, the lineheads 1800 are movable in two dimensions, but not three dimensions. The lineheads 1800 cannot be positioned up or down relative to the print media. Other embodiments can move the lineheads in three dimensions to remove skew in the print media.

Figure 19:
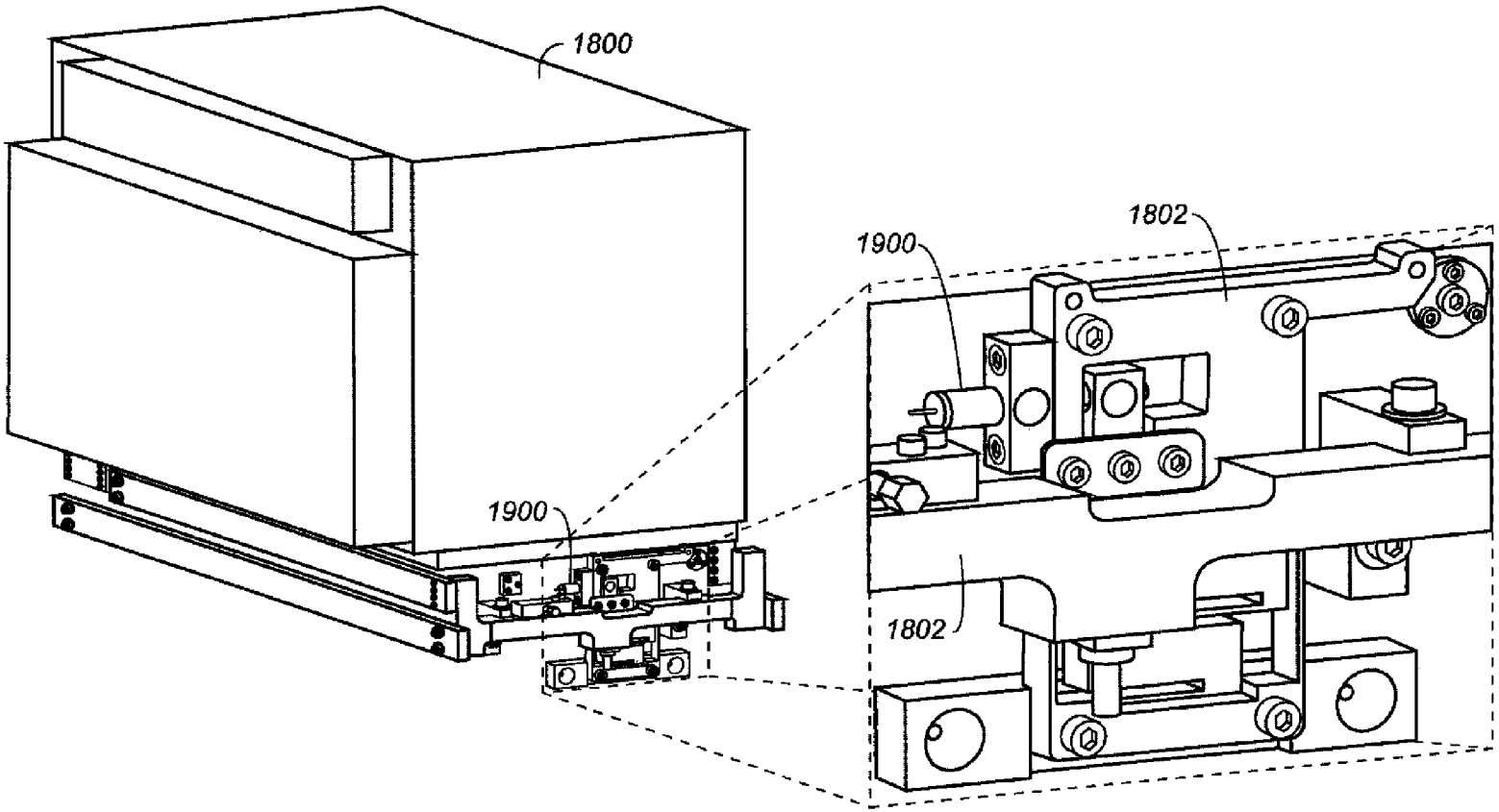
FIG. 19 depicts an example of a linehead and a linehead skew adjustment mechanism in an embodiment in accordance with the invention.

The skew of the lineheads 1800 is adjusted using a linehead skew adjustment mechanism 1900 (FIG. 19). The linehead skew adjustment mechanism 1900 moves or rotates the movable support 1802, which adjusts the skew of the lineheads. In the illustrated embodiment, the linehead skew adjustment mechanism is a servo motor. The configuration of the servo motor is conventional and commercially available. For example, a servo motor distributed by Ultra Motion, located in Cutchogue, N.Y. can be used as a linehead skew adjustment mechanism 1900. Alternatively, any conventional servo motor can be used provided it has the performance characteristics to make the servo motor suitable for the type of steering contemplated herein. Additionally, a stepper motor, a piezoelectric stack, pneumatics with a variable regulator, or a solenoid can be used as a linehead skew adjustment mechanism in other embodiments in accordance with the invention.

And finally, although FIG. 19 depicts only one linehead skew adjustment mechanism, two or more linehead skew adjustment mechanisms can be used to adjust the skew of one linehead in embodiments in accordance with the invention. The two or more linehead skew adjustment mechanisms can be implemented with the same type of adjustment mechanism or with different adjustment mechanisms. For example, if two linehead skew adjustment mechanisms are used, one can be a servo motor and the other a piezoelectric stack.

The invention has been described in detail with particular reference to certain preferred embodiments thereof, but it will be understood that variations and modifications can be effected within the spirit and scope of the invention. And even though specific embodiments of the invention have been described herein, it should be noted that the application is not limited to these embodiments. In particular, any features described with respect to one embodiment may also be used in other embodiments, where compatible. The features of the different embodiments may be exchanged, where compatible.

1. A printing system includes a linehead that jets ink onto a surface of the print media, an imaging system that captures images of the surface of the print media, a roller to support the print media, and a roller deformation adjustment mechanism that abuts the roller. By way of example only, the roller can be positioned opposite the linehead. A method for compensating for web skew in the printing system includes capturing images of one or more test marks printed or formed on the print media and analyzing the images to determine whether the print media is skewed with respect to a transport direction of the print media. If the print media is skewed, one or more compensation values are determined and the roller is deformed based on the one or more compensation values. The deformation of the roller changes a relative timing of drop flight times of ink between the linehead and the surface of the print media.

2. The printing system or method as in clause 1, where the roller deformation adjustment mechanism can include two adjustment rollers abutting the roller and a drive system connected to the two adjustment rollers.

3. The printing system or method as in clause 2, where deforming the roller based on the one or more compensation values can include determining a set point for the drive system.

4. The printing system or method in any one of clauses 1-3 can include prior to determining one or more compensation values, determining whether the skew of the print media equals or exceeds a threshold value. One or more compensation values is determined if the skew of the print media equals or exceeds the threshold value.

5. The printing system or method in any one of clauses 1-4 can include one or more linehead skew adjustment mechanisms that are adapted to adjust the skew of the linehead. If the print media is skewed, the method can include determining one or more linehead skew adjustment values and adjusting the skew of the linehead based on the one or more linehead skew adjustment values.

6. The printing system or method as in clause 5, where the linehead can be disposed on a moveable support and adjusting the skew of the linehead based on the one or more linehead skew adjustment values can include moving the moveable support based on the one or more linehead skew adjustment values.

7. The printing system or method as in clause 5 or clause 6, where the at least one linehead skew adjustment mechanism can include a servo motor and adjusting the skew of the linehead based on the one or more linehead skew adjustment values includes determining a set point for the servo motor.

8. The printing system or method in any one of clauses 5-7 can include prior to determining one or more linehead skew adjustment values, determining whether the skew of the print media equals or exceeds a threshold value. One or more linehead skew adjustment values is determined if the skew of the print media equals or exceeds a threshold value.

9. The printing system or method as in any one of clauses 1-8, where analyzing the images to determine whether the print media is skewed can include comparing at least one test mark with a reference test mark.

10. The printing system or method in any one of clauses 1-9 can include a processing device. The processing device can be connected to the imaging system.

11. The printing system or method in any one of clauses 1-10 can include a storage device. The storage device can be connected to the processing device.

PARTS LIST

100 print media
102 media operation zone
104 center line of print media
106 linehead
200 streams of ink drops
300 print line
500 print line
600 printing system
602 printing module
604 printing module
606 linehead
608 dryer
610 quality control sensor
612 print media
614 media transport direction
616 turnover module
618 processing device
620 storage device
700 printhead
702 nozzle array
704 support structure
706 heat
708 roller
800 print line
802 overlap region
1000 print media
1002 content area
1004 margin
1006 test marks
1100 roller
1102 end of roller
1104 end of roller
1106 streams of ink drops
1108 linehead
1110 print media
1112 print lines
1200 roller
1202 end of roller
1204 end of roller
1206 streams of ink drops
1208 linehead
1210 print media
1212 print lines
1300 roller deformation adjustment mechanism
1302 roller
1304 adjustment roller
1306 drive system
1308 represents increased or decreased amount of force
1600-1 linehead
1600-2 linehead
1600-3 linehead
1600-4 linehead
1602 print media
1604 line representing cross-track direction
1606 print lines
1700-1 linehead
1700-2 linehead
1700-3 linehead
1700-4 linehead
1702 print media
1704 line representing cross-track direction
1706 print lines
1800 linehead
1800-1 linehead
1800-2 linehead
1800-3 linehead
1800-4 linehead
1802 moveable support
1804 line
1900 linehead skew adjustment mechanism
D distance

The invention claimed is:

1. A printing system, comprising:

a roller supporting a first side of a print media;

an inkjet printhead positioned on the opposite side of the print media from the first side of the print media, the inkjet printhead having an array of nozzles to jet drops of ink onto the print media, the drops of ink having a flight time corresponding to the amount of time taken by the drops of ink to travel from the printhead to the print media, wherein the roller is aligned with the inkjet printhead;

a roller deformation adjustment mechanism configured to apply a force to the roller to deform the roller, to thereby change the flight time for the drops of ink, and wherein the flight time of drops in one portion of the roller is different from the flight time of drops in another portion of the roller.

2. The printing system as in claim 1, further comprising an imaging system that captures images of the print media.

3. The printing system as in claim 2, further comprising a processing device connected to the imaging system.

4. The printing system as in claim 3, further comprising a storage device connected to the processing device.

5. The printing system as in claim 4, wherein the drive system comprises a servo motor.

6. The printing system as in claim 1, wherein the roller deformation adjustment mechanism comprises two adjustment rollers abutting the roller and a drive system connected to the two adjustment rollers.

* * * * *